US008114223B2

(12) United States Patent
Brueckner et al.

(10) Patent No.: US 8,114,223 B2
(45) Date of Patent: Feb. 14, 2012

(54) GLASS CLEANER COMPRISING AN ALKYLPYRROLIDONE, GLYCOL ETHER, AND ANIONIC SURFACTANT

(75) Inventors: Erik Brueckner, Hilden (DE); Juergen Noglich, Duesseldorf (DE); Stefan Karsten, Gummersbach (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/554,274

(22) Filed: Sep. 4, 2009

(65) Prior Publication Data

US 2010/0062965 A1 Mar. 11, 2010

Related U.S. Application Data

(63) Continuation of application No. PCT/EP2007/063777, filed on Dec. 12, 2007.

(30) Foreign Application Priority Data

Mar. 7, 2007 (DE) ..... 10 2007 011 491

(51) Int. Cl.

| | |
|---|---|
| ***B08B 3/04*** | (2006.01) |
| ***C11D 1/02*** | (2006.01) |
| ***C11D 3/08*** | (2006.01) |
| ***C11D 3/28*** | (2006.01) |
| ***C11D 3/43*** | (2006.01) |

(52) U.S. Cl. ..... 134/39; 134/40; 134/42; 510/163; 510/179; 510/182; 510/243; 510/426; 510/432; 510/433; 510/466; 510/500; 510/511

(58) Field of Classification Search ..... 510/163, 510/179, 182, 243, 426, 432, 433, 466, 500, 510/511; 134/39, 40, 42
See application file for complete search history.

(56) References Cited

U.S. PATENT DOCUMENTS

| | | | | |
|---|---|---|---|---|
| 7,314,852 | B1 * | 1/2008 | Cummings et al. | 510/163 |
| 2005/0239674 | A1 * | 10/2005 | Dreja et al. | 510/180 |

FOREIGN PATENT DOCUMENTS

| | | | | |
|---|---|---|---|---|
| WO | WO 98/55570 | A1 | | 12/1998 |
| WO | WO 99/31212 | | * | 6/1999 |
| WO | WO 99/31212 | A1 | | 6/1999 |
| WO | WO 02/50225 | | * | 6/2002 |
| WO | WO 02/50225 | A1 | | 6/2002 |
| WO | WO 2004/055145 | A1 | | 7/2004 |
| WO | WO 2005/100523 | A1 | | 10/2005 |

OTHER PUBLICATIONS

International Search Report of PCT/EP2007/063777, dated Apr. 21, 2008.

* cited by examiner

*Primary Examiner* — Brian P Mruk
(74) *Attorney, Agent, or Firm* — RatnerPrestia

(57) ABSTRACT

A cleaning agent for hard surfaces, which is made of a combination of at least one alkyl pyrrolidone, at least one glycol ether, and at least one anionic surfactant, exhibits very good cleaning power and cleaning speed for dirt of different kinds and can be utilized particularly for cleaning glass.

20 Claims, No Drawings

GLASS CLEANER COMPRISING AN ALKYLPYRROLIDONE, GLYCOL ETHER, AND ANIONIC SURFACTANT

CROSS-REFERENCE TO RELATED APPLICATIONS

This application is a continuation under 35 U.S.C. §§120 and 365(c) of International Application PCT/EP2007/063777, filed on Dec. 12, 2007. This application also claims priority under 35 U.S.C. §119 of DE 10 2007 011 491.7, filed on Mar. 7, 2007. The disclosures of PCT/EP2007/0063777 and DE 10 2007 011 491.7 are incorporated herein by reference in their entirety.

BACKGROUND OF THE INVENTION

The present application relates to a cleaning preparation for hard surfaces which contains a combination of an alkylpyrrolidone, at least one glycol ether and at least one anionic surfactant, and to the use of this preparation for cleaning hard surfaces, in particular glass.

One important criterion in formulating a glass cleaner is obviously its cleaning performance, in particular also in terms of greasy soiling. Good residue behavior is, however, additionally desired. Moreover, in modern households, large areas of glass, for example windows, are cleaned more rarely than was usual in the past. Efforts are accordingly being made to formulate glass cleaners in such a manner as to prevent or minimize the formation of lime spots and to reduce susceptibility to resoiling on surfaces cleaned with this preparation.

DESCRIPTION OF THE INVENTION

It was therefore desirable to find a cleaning preparation which effectively cleans hard surfaces, in particular of glass, modifies the surface hydrophilically and, in so doing, exhibits good residue behavior.

It has now been found that cleaning performance and speed on greasy and tarry soiling together with residue behavior and durability of a hydrophilic surface modification may be significantly increased by using a combination of an alkylpyrrolidone, a glycol ether and an anionic surfactant.

The present application accordingly provides a cleaning preparation for hard surfaces which contains a combination of at least one alkylpyrrolidone, at least one glycol ether and at least one anionic surfactant. The application further provides the use of this preparation for cleaning hard surfaces, in particular glass.

For the purposes of the present invention, unless otherwise stated, fatty acids or fatty alcohols or the derivatives thereof are representative of branched or unbranched carboxylic acids or alcohols or the derivatives thereof having preferably 6 to 22 carbon atoms. The former, being plant-based and derived from renewable raw materials, are in particular preferred for environmental reasons, but the teaching according to the invention is not limited thereto. In particular, oxo alcohols obtainable by Roelen's oxo synthesis or the derivatives thereof may for example also be put to corresponding use.

Whenever alkaline earth metals are mentioned below as counterions for monovalent anions, this means that the alkaline earth metal is, of course, only present in half the molar quantity (sufficient for charge balancing) as the anion.

Substances which also serve as ingredients in cosmetics are, where applicable, named in accordance with the International Nomenclature of Cosmetic Ingredients (INCI). Chemical compounds have an INCI name in English, plant ingredients are only listed in Latin using the Linnaean classification. "Common" names such as "water", "honey" or "sea salt" are likewise stated in Latin. INCI names may be found in the "International Cosmetic Ingredient Dictionary and Handbook, Seventh Edition (1997)" which is published by The Cosmetic, Toiletry and Fragrance Association (CTFA), 1101, 17th Street NW, Suite 300, Washington, D.C. 20036, USA, and contains more than 9,000 INCI names and references to more than 37,000 trade names and technical terms including the associated distributors from more than 31 countries. The International Cosmetic Ingredient Dictionary and Handbook assigns the ingredients one or more chemical classes, for example "polymeric ethers", and one or more functions, for example "Surfactants—Cleansing Agents", which it in turn explains in greater detail. Where applicable, reference is made thereto below.

The abbreviation CAS means that the following sequence of numbers is a Chemical Abstracts Service number.

Unless explicitly stated otherwise, the quantities stated in weight percent (wt. %) relate to the entire preparation. These percentage quantities here relate to active contents.

Alkylpyrrolidone

The preparation according to the invention contains an alkylpyrrolidone. Suitable alkylpyrrolidones here comprise a $C_{6-16}$ alkyl chain, in particular a $C_{8-18}$ alkyl chain. 1-Octyl-2-pyrrolidone is here particularly preferred. This is obtainable, for example, under the trade name Surfadone® LP-100 from International Specialty Products. The alkylpyrrolidone is preferably used in quantities of 0.001 to 1.0 wt. %, particularly preferably in quantities of 0.005 to 0.05 wt. %.

Glycol Ethers

The cleaning preparation according to the invention furthermore contains one or more glycol ethers. $C_{2-6}$ alkylene glycols etherified on one side with a $C_{1-6}$ alkanol are here preferred.

Glycol ethers which may be mentioned by way of example are the following compounds according to INCI nomenclature: Butoxydiglycol, Butoxyethanol, Butoxyisopropanol, Butoxypropanol, Dimethoxydiglycol, Ethoxydiglycol, Ethoxyethanol, Hexylene Glycol, Isobutoxypropanol, 3-Methoxybutanol, Methoxydiglycol, Methoxyethanol, Methoxyisopropanol, Methoxymethylbutanol, Propylene Glycol Butyl Ether, Propylene Glycol Propyl Ether.

The glycol ether is preferably selected from the group comprising ethylene glycol monobutyl ether, ethylene glycol monopropyl ether, propylene glycol monobutyl ether, propylene glycol monopropyl ether and mixtures thereof. Propylene glycol monobutyl ether and/or ethylene glycol monobutyl ether are extremely preferred.

The preparation according to the invention preferably contains glycol ethers in quantities of 0.5 to 10 wt. %, particularly preferably of 1 to 5 wt. %.

Anionic Surfactants

The preparation according to the invention furthermore contains at least one anionic surfactant. Preferred anionic surfactants for the purposes of the present invention are $C_8$-$C_{18}$ monoalkyl sulfates (in particular fatty alcohol sulfates), $C_8$-$C_{18}$ alkyl polyglycol ether sulfates (fatty alcohol ether sulfates) with 2 to 6 ethylene oxide units (EO) in the ether moiety, $C_8$-$C_{20}$ alkane sulfonates, $C_8$-$C_{18}$ alkylbenzene sulfonates, in particular with around 12 C atoms in the alkyl moiety, and sulfosuccinic acid mono- and di-$C_8$-$C_{18}$-alkyl esters. It is furthermore also possible to use $C_8$-$C_{18}$ α-olefin sulfonates, sulfonated $C_8$-$C_{18}$ fatty acids, in particular dodecylbenzenesulfonate, $C_8$-$C_{22}$ carboxylic acid amide ether sulfates, $C_8$-$C_{18}$ alkyl polyglycol ether carboxylates, $C_8$-$C_{18}$ N-acyl taurides and $C_8$-$C_{18}$ alkyl isethionates or mixtures thereof. Fatty alcohol sulfates and/or fatty alcohol ether sulfates are preferably used.

The anionic surfactants are preferably used as sodium salts, but may also be present as other alkali or alkaline earth metal salts, for example magnesium salts, and in the form of ammonium or mono-, di-, tri- or tetraalkylammonium salts, in the case of sulfonates, also in the form of their corresponding acid, for example dodecylbenzenesulfonic acid.

Fatty Alcohol Sulfates

Preferred alkyl sulfates (fatty alcohol sulfates, FAS) are the alkali metal and in particular sodium salts of sulfuric acid semi-esters of $C_{12-18}$ fatty alcohols for example prepared from coconut fatty alcohol, tallow fatty alcohol, lauryl, myristyl, cetyl or stearyl alcohol or $C_{10-20}$ oxo alcohols and those semi-esters of secondary alcohols of these chain lengths. Alkyl sulfates of the stated chain length which contain a synthetic straight-chain alkyl residue produced on a petrochemical basis and which exhibit degradation behavior similar to that of the appropriate compounds based on fatty chemical raw materials are also preferred. Particular preference is here given to $C_{10}$-$C_{16}$ alkyl sulfates, in particular $C_{12-14}$ alkyl sulfates. Alkyl sulfates may moreover also be used with mono- or poly-branched alkyl chains or cyclic alkyl residues. The fatty alcohol sulfates are conventionally used as an alkali metal, alkaline earth metal and/or mono-, di- or trialkanolammonium salt and/or alternatively also in the form of the corresponding acid thereof to be neutralized in situ with the corresponding alkali metal hydroxide, alkaline earth metal hydroxide and/or mono-, di- or trialkanolamine. Preferred alkali metals are here potassium and in particular sodium, while preferred alkaline earth metals are calcium and in particular magnesium, and preferred alkanolamines are mono-, di- or triethanolamine.

Preferably used fatty alcohol sulfates are here above all sodium lauryl sulfate or monoethanolamine lauryl sulfate.

Fatty Alcohol Ether Sulfates

Alkyl ether sulfates (fatty alcohol ether sulfates, INCI Alkyl Ether Sulfates) are products of sulfation reactions on alkoxylated alcohols. A person skilled in the art generally takes alkoxylated alcohols to be the reaction products of alkylene oxide, preferably ethylene oxide, with alcohols, for the purposes of the present invention preferably with longer-chain alcohols, i.e. with aliphatic straight-chain or mono- or poly-branched, acyclic or cyclic, saturated or mono- or polyunsaturated, preferably straight-chain, acyclic, saturated, alcohols with 6 to 22, preferably 8 to 18, in particular 10 to 16 and particularly preferably 12 to 14 carbon atoms. In general, n moles of ethylene oxide and one mole of alcohol give rise, depending on the reaction conditions, to a complex mixture of addition products of differing degrees of ethoxylation (n=1 to 30, preferably 1 to 20, in particular 1 to 10, particularly preferably 2 to 4). A further embodiment of alkoxylation involves the use of mixtures of alkylene oxides, preferably a mixture of ethylene oxide and propylene oxide. Low-ethoxylated fatty alcohols with 1 to 4 ethylene oxide units (EO), in particular 1 to 2 EO, for example 2 EO, such as $NaC_{12-14}$ fatty alcohol+2EO sulfate are very particularly preferred for the purposes of the present invention.

Particularly preferred anionic surfactants are sodium lauryl sulfate and sodium lauryl ether sulfate with 2 EO. The preparation according to the invention contains anionic surfactants preferably in quantities of 0.01 to 30 wt. %, in particular of 0.1 to 1 wt. %.

Silicon Oxide

The preparation according to the invention may contain a silicon oxide as a further ingredient. Nanoparticulate silicon dioxide, preferably colloidal silica sol, in which the silicon dioxide is present in nanoparticulate form, is in particular suitable. This is well suited to hydrophilizing surfaces. Colloidal nanoparticulate silica sols for the purposes of the present invention are stable dispersions of amorphous particulate silicon dioxide $SiO_2$ with particle sizes in the range from 1 to 100 nm. The particle sizes are here in the range from 3 to 50 nm, particularly preferably from 4 to 40 nm. One example of a silica sol which is suitable for use for the purposes of the present invention is the silica sol with a particle size of 9 nm obtainable under the trade name Bindzil® 30/360 from Akzo. Further suitable silica sols are Bindzil® 15/500, 30/220, 40/200 (Akzo), Nyacol® 215, 830, 1430, 2034DI and Nyacol® DP5820, DP5480, DP5540 etc. (Nyacol Products), Levasil® 100/30, 100F/30, 100S/30, 200/30, 200F/30, 300F/30, VP 4038, VP 4055 (H.C. Starck/Bayer) or also CAB-O-SPERSE® PG 001, PG 002 (aqueous dispersions of CAB-O-SIL®, Cabot), Quartron PL-1, PL-3 (FusoChemical Co.), Köstrosol 0830, 1030, 1430 (Chemiewerk Bad Köstritz). The silica sols used may also be a surface-modified silica which has been treated with sodium aluminate (alumina-modified silica).

The preparation according to the invention may contain up to 1 wt. %, preferably 0.01 to 0.5 wt. %, of silicon oxide.

In a preferred embodiment, the preparation according to the invention contains alkylpyrrolidone, anionic surfactant, glycol ether and silicon oxide in a mass ratio 1:30:200:10.

Further Ingredients

In addition to the above-stated ingredients, the preparation according to the invention may contain further auxiliary substances and additives. These include in particular further agents for modifying or hydrophilizing surfaces, polymers, pH adjusting agents, acids, bases, further solvents, further surfactants, preservatives, corrosion inhibitors, dyes, fragrances, bleaching agents, enzymes, thickeners, disinfectants, electrolyte salts, antimicrobial active ingredients, UV stabilizers and mixtures thereof.

Further Agents for Surface Modification/Hydrophilization

In addition to nanoparticulate silicon dioxide, certain polymers may also be used for hydrophilizing surfaces. Suitable hydrophilizing polymers are in particular amphoteric polymers, for example copolymers prepared from acrylic or methacrylic acid and MAPTAC, DADMAC or another polymerizable quaternary ammonium compound. Copolymers with AMPS (2-acrylamido-2-methylpropanesulfonic acid) may furthermore also be used. Polyethersiloxanes, namely copolymers of polymethylsiloxanes with ethylene oxide or propylene oxide segments, are further suitable polymers. Acrylic polymers, maleic acid copolymers and polyurethanes with PEG (polyethylene glycol) units are likewise usable.

Suitable polymers are for example commercially obtainable under the trade names Mirapol Surf-S 100, 110, 200, 210, 400, 410, A 300, A 400 (Rhodia), Tegopren 5843 (Goldschmidt), Sokalan CP 9 (BASF) or Polyquart Ampho 149 (Cognis).

Volatile Alkali; Bases

The preparations according to the invention may furthermore contain volatile alkali. Ammonia and/or alkanolamines, which may contain up to 9 C atoms per molecule, are used as such. Among alkanolamines, ethanolamines are preferred and, among these, monoethanolamine is in turn preferred. The content of ammonia and/or alkanolamine preferably amounts to 0.01 to 0.5 wt. %; ammonia is particularly preferably used.

In addition, the cleaning preparations according to the invention, especially those formulations with an acidic pH value, may also contain small quantities of bases. Preferred bases originate from the group of alkali metal and alkaline earth metal hydroxides and carbonates, in particular of alkali metal hydroxides, among which potassium hydroxide and above all sodium hydroxide are particularly preferred. Bases are used in the acidic preparations in quantities of no more than 1 wt. %, preferably of 0.01 to 0.1 wt. %.

Acids

Alkaline preparations may, apart from to the volatile alkali, additionally contain carboxylic acids, the equivalent ratio of amine and/or ammonia to carboxylic acid preferably being between 1:0.9 and 1:0.1. Carboxylic acids with up to 6 C atoms are suitable, these possibly comprising mono-, di- or polycarboxylic acids. Depending on the equivalent weight of amine and carboxylic acid, the content of carboxylic acid is preferably between 0.01 and 2.7 wt. %, in particular between 0.01 and 0.9 wt. %. Examples of suitable carboxylic acids are acetic acid, glycolic acid, lactic acid, citric acid, succinic acid, adipic acid, malic acid, tartaric acid and gluconic acid, among which acetic acid, citric acid and lactic acid are preferably used. Acetic acid is particularly preferably used.

Acidic cleaning preparations according to the invention may also contain acids instead of volatile alkali. Suitable acids are in particular organic acids such as the above-stated carboxylic acids, acetic acid, citric acid, glycolic acid, lactic acid, succinic acid, adipic acid, malic acid, tartaric acid and gluconic acid or also amidosulfonic acid. The inorganic acids hydrochloric acid, sulfuric acid and nitric acid or mixtures thereof may, however, additionally be used. Particularly preferred acids are those selected from the group comprising amidosulfonic acid, citric acid and formic acid. They are preferably used in quantities of 0.1 to 5 wt. %, particularly preferably of 0.5 to 4 wt. %, in particular of 1 to 3 wt. %.

Further Solvents

The preparation according to the invention may contain one or more further water-soluble organic solvents.

Suitable solvents are for example saturated or unsaturated, preferably saturated, branched or unbranched $C_{1-20}$ hydrocarbons, preferably $C_{2-15}$ hydrocarbons, with at least one hydroxyl group and optionally one or more C—O—C ether functions, i.e. oxygen atoms interrupting the carbon atom chain.

Preferred solvents are preferably selected from the group comprising $C_{1-6}$ alcohols, $C_{2-6}$ diols and mixtures thereof, in particular selected from the group comprising ethanol, isopropanol, n-propanol, n-butanol, ethylene glycol, diethylene glycol, propylene glycol and mixtures thereof, particularly preferably ethanol, isopropanol, ethylene glycol, propylene glycol and mixtures thereof.

Further preferred solvents are poly-$C_{2-3}$-alkylene glycol ethers (PEG ethers, PPG ethers) with on average 1 to 9 identical or different, preferably identical, alkylene glycol groups per molecule.

Solvents which may be mentioned by way of example are the following compounds according to INCI nomenclature: Alcohol (Ethanol), Buteth-3, n-Butyl Alcohol, t-Butyl Alcohol, Butylene Glycol, Butyloctanol, Diethylene Glycol, Dimethyl Ether, Dipropylene Glycol, Ethyl Hexanediol, Glycol, Hexanediol, 1,2,6-Hexanetriol, Hexyl Alcohol, Hexylene Glycol, Isopentyldiol, Isopropanol (INCI Isopropyl Alcohol) Methoxy PEG-10, Methylal, Methyl Alcohol, Methyl Hexyl Ether, Methylpropanediol, Neopentyl Glycol, PEG-4, PEG-6, PEG-7, PEG-8, PEG-9, PEG-6 Methyl Ether, Pentylene Glycol, PPG-7, PPG-2-Buteth-3, PPG-2 Butyl Ether, PPG-3 Butyl Ether, PPG-2 Methyl Ether, PPG-3 Methyl Ether, PPG-2 Propyl Ether, Propanediol, Propyl Alcohol (n-Propanol), Propylene Glycol, Tetrahydrofurfuryl Alcohol, Trimethylhexanol.

Further Surfactants

Apart from anionic surfactants, the preparation according to the invention may also contain further surface-active substances (surfactants), in particular from the class of nonionic surfactants.

Nonionic surfactants which may primarily be mentioned are $C_8$-$C_{18}$ alcohol polyglycol ethers, i.e. ethoxylated and/or propoxylated alcohols with 8 to 18 C atoms in the alkyl moiety and 2 to 15 ethylene oxide (EO) and/or propylene oxide (PO) units, $C_8$-$C_{18}$ carboxylic acid polyglycol esters with 2 to 15 EO, for example tallow fatty acid+6 EO esters, ethoxylated fatty acid amides with 12 to 18 C atoms in the fatty acid moiety and 2 to 8 EO, long-chain amine oxides with 14 to 20 C atoms and long-chain alkyl polyglycosides with 8 to 14 C atoms in the alkyl moiety and 1 to 3 glycoside units. Examples of such surfactants are oleyl-cetyl alcohol with 5 EO, nonylphenol with 10 EO, lauric acid diethanolamide, cocoalkyl dimethylamine oxide and cocoalkyl polyglucoside with on average 1.4 glucose units. End group-terminated $C_8$-$C_{18}$ alkyl alcohol polyglycol ethers may furthermore also be used, i.e. compounds in which the normally free OH group of the $C_8$-$C_{18}$ alkyl alcohol polyglycol ether is etherified. Nitrogenous surfactants may be present as further nonionic surfactants, for example fatty acid polyhydroxyamides, for example glucamides, and ethoxylates of alkylamines, vicinal diols and/or carboxamides which have alkyl groups with 10 to 22 C atoms, preferably 12 to 18 C atoms. The degree of ethoxylation of these compounds is here generally between 1 and 20, preferably between 3 and 10. Ethanolamide derivatives of alkanoic acids with 8 to 22 C atoms, preferably 12 to 16 C atoms, are preferred.

In a preferred embodiment, however, the preparation according to the invention contains no alkoxylated nonionic surfactants.

In addition to the previously stated surfactants, the preparation according to the invention may furthermore also contain cationic surfactants and/or amphoteric surfactants.

Suitable amphoteric surfactants are for example betaines of the formula $(R^{iii})(R^{iv})(R^{v})N^{+}CH_2COO^{-}$, in which $R^{iii}$ means an alkyl residue with 8 to 25, preferably 10 to 21 carbon atoms optionally interrupted by heteroatoms or groups of heteroatoms and $R^{iv}$ and $R^{v}$ mean identical or different alkyl residues with 1 to 3 carbon atoms, in particular $C_{10}$-$C_{18}$ alkyl dimethyl carboxymethyl betaine and $C_{11}$-$C_{17}$ alkylamidopropyl dimethyl carboxymethyl betaine. The preparations contain amphoteric surfactants in quantities, relative to the composition, of 0 to 10 wt. %.

Suitable cationic surfactants are inter alia the quaternary ammonium compounds of the formula $(R^{vi})(R^{vii})(R^{viii})(R^{ix})N^{+}X^{-}$, in which $R^{vi}$ to $R^{ix}$ denote four identical or different, in particular two long-chain and two short-chain, alkyl residues and $X^{-}$ denotes an anion, in particular a halide ion, for example didecyldimethylammonium chloride, alkylbenzyldidecylammonium chloride and mixtures thereof. The preparations contain cationic surfactants in quantities, relative to the composition, of 0 to 10 wt. %.

In a particularly preferred embodiment, however, the preparation contains no further surfactant components other than anionic surfactants.

Viscosity

The preparation preferably exhibits a Brookfield viscosity (model DV-II+, spindle 31, frequency of rotation 20 $min^{-1}$, 20° C.) of 0.1 to 200 mPa·s, in particular of 0.5 to 100 mPa·s, extremely preferably of 1 to 60 mPa·s. The preparation may contain viscosity regulators for this purpose. The quantity of viscosity regulator conventionally amounts to up to 0.5 wt. %, preferably 0.001 to 0.3 wt. %, in particular 0.01 to 0.2 wt. %, extremely preferably 0.01 to 0.15 wt. %.

Viscosity Regulators

Suitable viscosity regulators are for example organic natural thickeners (agar-agar, carrageenan, tragacanth, gum arabic, alginates, pectins, polyoses, guar flour, locust bean flour, starch, dextrins, gelatin, casein), modified organic natural substances (carboxymethylcellulose and other cellulose ethers, hydroxyethylcellulose and hydroxypropylcellulose and the like, seed flour ethers), completely synthetic organic thickeners (polyacrylic and polymethacrylic compounds, vinyl polymers, polycarboxylic acids, polyethers, polyimines, polyamides) and inorganic thickeners (polysilicic acids, clay minerals such as montmorillonites, zeolites, silicas).

The polyacrylic and polymethacrylic compounds include, for example, the high molecular weight homopolymers, crosslinked with a polyalkenyl polyether, in particular an allyl ether of sucrose, pentaerythritol or propylene, of acrylic acid (INCI name according to International Dictionary of Cosmetic Ingredients of The Cosmetic, Toiletry, and Fragrance Association (CTFA): Carbomer), which are also known as carboxyvinyl polymers. Such polyacrylic acids are obtainable inter alia from 3V Sigma under the trade name Polygel®, for example Polygel® DA, and from B.F. Goodrich under the trade name Carbopol®, for example Carbopol® 940 (molecular weight approx. 4,000,000), Carbopol® 941 (molecular weight approx. 1,250,000) or Carbopol® 934 (molecular weight approx. 3,000,000). They furthermore include the following acrylic acid copolymers: (i) copolymers of two or more monomers from the group of acrylic acid, methacrylic acid and the simple esters thereof, preferably formed with $C_{1-4}$ alkanols (INCI Acrylates Copolymer), which include for instance the copolymers of methacrylic acid, butyl acrylate and methyl methacrylate (CAS name according to Chemical Abstracts Service: 25035-69-2) or of butyl acrylate and methyl methacrylate (CAS 25852-37-3) and which are obtainable for example from Rohm & Haas under the trade names Aculyn® and Acusol® and from Degussa (Goldschmidt) under the trade name Tego® Polymer, for example the anionic non-associative polymers Aculyn® 22, Aculyn® 28, Aculyn® 33 (crosslinked), Acusol® 810, Acusol® 823 and Acusol® 830 (CAS 25852-37-3); (ii) crosslinked high molecular weight acrylic acid copolymers, which include for instance the copolymers, crosslinked with an allyl ether of sucrose or of pentaerythritol, of $C_{10-30}$ alkyl acrylates with one or more monomers from the group of acrylic acid, methacrylic acid and the simple esters thereof, preferably formed with $C_{1-4}$ alkanols (INCI Acrylates/C10-30 Alkyl Acrylate Crosspolymer) and which are obtainable for example from B.F. Goodrich under the trade name Carbopol®, for example hydrophobized Carbopol® ETD 2623 and Carbopol® 1382 (INCI Acrylates/C10-30 Alkyl Acrylate Crosspolymer) and Carbopol® AQUA 30 (formerly Carbopol® EX 473).

Further thickeners are polysaccharides and heteropolysaccharides, in particular polysaccharide gums, for example gum arabic, agar, alginates, carageenans and the salts thereof, guar, guaran, tragacanth, gellan, ramsan, dextran or xanthan and the derivatives thereof, for example propoxylated guar, and mixtures thereof. Other polysaccharide thickeners, such as starches or cellulose derivatives, may however alternatively preferably be used in addition to a polysaccharide gum, for example starches of the most varied origin and starch derivatives, for example hydroxyethyl starch, starch phosphate esters or starch acetates, or carboxymethylcellulose or the sodium salt thereof, methyl-, ethyl-, hydroxyethyl-, hydroxypropyl-, hydroxypropylmethyl- or hydroxyethylmethylcellulose or cellulose acetate. One particularly preferred polysaccharide thickener is the microbial anionic heteropolysaccharide xanthan gum, which is produced by *Xanthomonas campestris* and some other species under aerobic conditions, with a molecular weight of $2\text{-}15\times10^6$ and is obtainable for example from Kelco under the trade names Keltrol® and Kelzan® or also from Rhodia under the trade name Rhodopol®.

Phyllosilicates may furthermore be used as thickeners. These include for example the magnesium or sodium/magnesium phyllosilicates obtainable under the trade name Laponite® from Solvay Alkali, in particular Laponite® RD or also Laponite® RDS, and magnesium silicates from Süd-Chemie, especially Optigel® SH.

When selecting the suitable viscosity regulator, care must be taken to ensure that the transparent appearance of the cleaning preparation is retained, i.e. using the thickener should not result in turbidity of the preparation.

Viscosity regulators may in particular be used in cleaning preparations according to the invention which are formulated as multipurpose cleaners. In contrast, in a particularly preferred embodiment, glass cleaners according to the invention contain no such additives.

Further Ingredients

In addition to the stated components, the preparations according to the invention may contain further auxiliary substances and additives as are conventional in such preparations. These include in particular dyes, fragrances (perfume oils), antistatic substances, preservatives, corrosion inhibitors, complexing agents for alkaline earth ions, enzymes, bleaching systems, disinfectants, UV absorbers, electrolyte salts and UV stabilizers. The quantity of such additives in the cleaning preparation is conventionally no more than 2 wt. %. The lower limit of use depends on the nature of the additive and, for example with dyes, may be down to 0.001 wt. % and below. The quantity of auxiliary substances is preferably between 0.01 and 1 wt. %.

The water content of the aqueous preparation according to the invention conventionally amounts to at least 90 wt. %, preferably at least 95 wt. %.

The pH value of the preparations according to the invention may be varied over a wide range, but a range from 2.5 to 12 is preferred. Glass cleaner formulations and multipurpose cleaners here in particular have a pH value of 6 to 11, extremely preferably of 7 to 10.5 while bathroom cleaners in particular have a pH value of 2 to 5, extremely preferably of 2.5 to 4.0.

The preparations according to the invention are preferably formulated in ready-to-use form. Formulation as a concentrate to be appropriately diluted before use is likewise possible for the purposes of the teaching according to the invention, in which case the ingredients are then present in the upper range of the stated quantity ranges.

The preparations according to the invention may be produced by directly mixing the raw materials thereof, subsequently mixing them thoroughly and finally allowing them to stand until they are free of bubbles.

While particular embodiments of the present invention have been illustrated and described, it would be obvious to those skilled in the art that various other changes and modifications can be made without departing from the spirit and scope of the invention.

Other than where otherwise indicated, or where required to distinguish over the prior art, all numbers expressing quantities of ingredients herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined herein otherwise. The conjunction "or" is used herein in both in the conjunctive and disjunctive sense, such that phrases or terms conjoined by "or" disclose or encompass each phrase or term alone as well as any combination so conjoined, unless specifically defined herein otherwise.

The description of a group or class of materials as suitable or preferred for a given purpose in connection with the invention implies that mixtures of any two or more of the members of the group or class are equally suitable or preferred. Description of constituents in chemical terms refers unless otherwise indicated, to the constituents at the time of addition to any combination specified in the description, and does not necessarily preclude chemical interactions among the constituents of a mixture once mixed. Steps in any method disclosed or claimed need not be performed in the order recited, except as otherwise specifically disclosed or claimed.

Changes in form and substitution of equivalents are contemplated as circumstances may suggest or render expedient. Although specific terms have been employed herein, such terms are intended in a descriptive sense and not for purposes of limitation.

The following Examples further illustrate the preferred embodiments within the scope of the present invention, but are not intended to be limiting thereof. It is understood that the examples and embodiments described herein are for illustrative purposes only and that various modifications or changes in light thereof will be suggested to one skilled in the art without departing from the scope of the present invention. The appended claims therefore are intended to cover all such changes and modifications that are within the scope of this invention.

The preparations according to the invention may be used for cleaning hard surfaces. In particular, they are suitable for use as glass cleaners.

Exemplary Embodiments

Cleaning preparations according to the invention, I 1 to I 7, and comparison formulations, C 1 to C 4, not falling within the subject matter of the present invention were prepared, the compositions of which are stated in the tables below. All quantities are here stated in wt. % of the active substance, relative to the entire preparation.

TABLE 1

| Compositions according to the invention | | | | | | | |
|---|---|---|---|---|---|---|---|
| | I 1 | I 2 | I 3 | I 4 | I 5 | I 6 | I 7 |
| Anionic surfactants | 0.3 | 0.3 | 0.3 | 0.3 | 0.3 | 0.3 | 0.3 |
| Propylene glycol monobutyl ether | 1.7 | 1.7 | — | 1.7 | 1.7 | 1.7 | — |
| Ethylene glycol monobutyl ether | — | — | 2.5 | — | — | — | 2.5 |
| 1-Octyl-2-pyrrolidone | 0.01 | 0.01 | 0.01 | 0.01 | 0.001 | 0.02 | 0.01 |
| Silicon dioxide | 0.1 | — | 0.1 | 0.1 | 0.1 | 0.1 | — |
| Ethanol/isopropanol | 5 | 5 | 1 | 5 | 5 | 5 | 5 |
| Ammonia | 0.02 | 0.02 | 0.02 | — | 0.02 | 0.02 | — |
| Perfume | 0.06 | 0.06 | 0.06 | 0.06 | 0.06 | 0.06 | 0.06 |
| Water | ad 100 | ad 100 | ad 100 | ad 100 | ad 100 | ad 100 | ad 100 |
| pH value | 10.3 | 10.3 | 10.3 | 9 | 10.3 | 10.3 | 9 |

TABLE 2

| Comparison formulations | | | | |
|---|---|---|---|---|
| | C 1 | C 2 | C 3 | C 4 |
| Anionic surfactants | 0.3 | 0.3 | 0.3 | 0.3 |
| Propylene glycol monobutyl ether | 1.7 | — | 1.7 | — |
| Ethylene glycol monobutyl ether | — | 2.5 | — | 2.5 |
| 1-Octyl-2-pyrrolidone | — | — | — | — |
| Silicon dioxide | 0.1 | 0.1 | 0.1 | 0.1 |
| Ethanol/isopropanol | 5 | 1 | 5 | 2 |
| Ammonia | 0.02 | 0.02 | — | — |
| Perfume | 0.06 | 0.06 | 0.06 | 0.06 |
| Water | ad 100 | ad 100 | ad 100 | ad 100 |
| pH value | 10.3 | 10.3 | 9 | 9 |

The formulations according to the invention, I 1 to I 7, without exception exhibited good to excellent cleaning performance relative to soiling by cigarette tar and very rapid cleaning relative to wax pencil. The formulations containing silicon dioxide were furthermore capable of hydrophilically modifying the treated surface over an extended period. In comparison, the comparison formulations not according to the invention were distinctly poorer in terms of both cleaning performance and speed of cleaning.

What is claimed:

1. A cleaning preparation, comprising at least one alkylpyrrolidone, at least one glycol ether, at least one anionic surfactant, and a silicon oxide.

2. The cleaning preparation of claim 1, comprising the at least one alkylpyrrolidone in quantities of 0.001 to 1.0 wt. %.

3. The cleaning preparation of claim 2, comprising the at least one anionic surfactant in quantities of 0.01 to 30 wt. %.

4. The cleaning preparation of claim 3, comprising the at least one glycol ether in quantities of 0.5 to 10 wt. %.

5. The cleaning preparation of claim 1, comprising 0.001 to 1.0 wt. % of the alkypyrrolidone, 0.01 to 30 wt. % of the anionic surfactant, 0.5 to 10 wt. % of the glycol ether, and up to 1 wt. % of the silicon oxide.

6. The cleaning preparation of claim 4, comprising up to 1 wt. % of silicon oxide.

7. The cleaning preparation of claim 6, wherein the silicon oxide comprises a nanoparticulate silicon dioxide.

8. The cleaning preparation of claim 6, wherein the silicon dioxide comprises a colloidal silica sol.

9. The cleaning preparation of claim 1, wherein the at least one alkylpyrrolidone comprises 1-octyl-2-pyrrolidone.

10. The cleaning preparation of claim 1, wherein the at least one anionic surfactant comprises a fatty alcohol sulfate and/or fatty alcohol ether sulfate.

11. The cleaning preparation of claim 1, wherein the at least one anionic surfactant comprises sodium lauryl sulfate and/or sodium lauryl ether sulfate with 2 EO.

12. The cleaning preparation of claim 1, wherein the at least one glycol ether component comprises ethylene glycol monobutyl ether, ethylene glycol monopropyl ether, propylene glycol monobutyl ether, propylene glycol monopropyl ether, or mixtures thereof.

13. The cleaning preparation of claim 1, comprising alkylpyrrolidone, anionic surfactant, glycol ether and silicon oxide in a mass ratio of 1:30:200:10.

14. The cleaning preparation of claim 1, further comprising further auxiliary substances and additives selected from the group consisting of salts, polymers, builder components, pH adjusting agents, acids, bases, fragrances, preservatives, disinfectants, thickeners, bleaching agents, enzymes, wetting agents, UV stabilizers, antimicrobial active ingredients, and mixtures thereof.

15. A method of cleaning a hard surface, comprising contacting a hard surface in need of cleaning with a cleaning-effective amount of the preparation of claim 1.

16. The cleaning preparation of claim 2, comprising the at least one alkylpyrrolidone in quantities of 0.005 to 0.05 wt. %.

17. The cleaning preparation of claim 3, comprising the at least one anionic surfactant in quantities of 0.1 to 1 wt %.

18. The cleaning preparation of claim 4, comprising the at least one glycol ether in quantities of 1 to 5 wt. %.

19. The cleaning preparation of claim 6, comprising 0.01 to 0.5 wt. % of silicon oxide.

20. The cleaning preparation of claim 5, comprising 0.005 to 0.05 wt. % of the alkypyrrolidone, 0.1 to 1 wt. % of the anionic surfactant, 1 to 5 wt. % of the glycol ether, and 0.01 to 0.5 wt. % of the silicon oxide.

* * * * *